US010347235B2

(12) United States Patent
Oppenheimer et al.

(10) Patent No.: US 10,347,235 B2
(45) Date of Patent: Jul. 9, 2019

(54) ACTIVE REDUCTION OF NOISE USING SYNCHRONIZATION SIGNALS

(71) Applicants: Yehuda Oppenheimer, Kiryat Tivon (IL); Yaron Salomonski, Kiryat Motzkin (IL)

(72) Inventors: Yehuda Oppenheimer, Kiryat Tivon (IL); Yaron Salomonski, Kiryat Motzkin (IL)

( * ) Notice: Subject to any disclaimer, the term of this patent is extended or adjusted under 35 U.S.C. 154(b) by 0 days.

(21) Appl. No.: 15/570,518

(22) PCT Filed: Jun. 1, 2016

(86) PCT No.: PCT/IL2016/000011
§ 371 (c)(1),
(2) Date: Oct. 30, 2017

(87) PCT Pub. No.: WO2016/199119
PCT Pub. Date: Dec. 15, 2016

(65) Prior Publication Data

US 2018/0158445 A1 Jun. 7, 2018

Related U.S. Application Data

(60) Provisional application No. 62/172,112, filed on Jun. 7, 2015.

(51) Int. Cl.
*H04R 3/04* (2006.01)
*H04R 29/00* (2006.01)
*G10K 11/178* (2006.01)

(52) U.S. Cl.
CPC .. *G10K 11/17823* (2018.01); *G10K 11/17815* (2018.01); *G10K 11/17837* (2018.01);
(Continued)

(58) Field of Classification Search
USPC ..... 381/13, 71.1, 71.7, 71.14, 73.1, 94.1, 381/94.5, 94.7, 57, 317
See application file for complete search history.

(56) References Cited

U.S. PATENT DOCUMENTS 5,617,479 A 4/1997 Hildebrand et al.
6,181,753 B1 1/2001 Takada et al.
(Continued)

OTHER PUBLICATIONS

International Search Report PCT/IL2016/000011 Completed Sep. 22, 2016; dated Sep. 25, 2016 4 pages.
(Continued)

*Primary Examiner* — Yosef K Laekemariam
(74) *Attorney, Agent, or Firm* — The Roy Gross Law Firm, LLC; Roy Gross

(57) ABSTRACT

Method and system for active reduction of a predefined audio acoustic signal (AAAS), also referred to as "noise", in a quiet zone, without interfering undefined acoustic noise signals within as well as outside the quiet zone, by generating accurate antiphase AAAS signal. The accuracy of the generated antiphase AAAS is obtained by employing a unique synchronization signal(s) (SYNC) which is generated and combined with the predefined AAAS. The combined signal is electrically transmitted (referred to as the "electric channel") to a processing "quieting component". Simultaneously, the generated SYNC signal is acoustically broadcasted near the predefined AAAS and merges with it. A microphone in the quiet zone receives the merged acoustic signals that arrive via the air (referred to as the "acoustical channel") to the quiet zone and a receiver in the quieting component receives the combined electrical AAAS and SYNC signal that arrive wire or wireless to the quiet zone. In the quiet component the SYNC is detected from both electrical and acoustical channels, the detected SYNC signals with the electrically received AAAS signal are used to
(Continued)

calculate the timing and momentary amplitude for generating an accurate acoustic antiphase AAAS signal to cancel the acoustic predefined AAAS. By continuously and periodically updating the SYNC signal enables to dynamically evaluate acoustical environmental distortions that might appear due to echo, reverberations, frequency non-linear response, or due to other distortions mechanisms.

20 Claims, 11 Drawing Sheets

(52) U.S. Cl.
CPC .. *G10K 11/17881* (2018.01); *G10K 11/17885* (2018.01); *H04R 3/04* (2013.01); *H04R 29/001* (2013.01); *G10K 2210/108* (2013.01); *G10K 2210/3044* (2013.01); *G10K 2210/3055* (2013.01); *G10K 2210/3216* (2013.01)

(56) References Cited

U.S. PATENT DOCUMENTS

2010/0260345 A1* 10/2010 Shridhar ..... G10K 11/178 381/71.1
2012/0057716 A1* 3/2012 Chang ..... G10K 11/178 381/71.1

OTHER PUBLICATIONS

Written Opinion of the International Searching Authority PCT/IL2016/000011 dated Sep. 25, 2016 4 pages.

* cited by examiner

ACTIVE REDUCTION OF NOISE USING SYNCHRONIZATION SIGNALS

RELATED APPLICATIONS

This application is a National Phase of PCT Patent Application No. PCT/IL2016/000011 having International filing date of Jun. 1, 2016, which claims the benefit of priority of U.S. Provisional Application No. 62/172,112 filed on Jun. 6, 2015 entitled A SYSTEM AND METHOD FOR ACTIVE REDUCTION OF A PREDEFINED AUDIO ACOUSTIC NOISE BY USING SYNCHRONIZATION SIGNALS. The contents of the above applications are all incorporated by reference as if fully set forth herein in their entirety.

FIELD OF THE INVENTION

A system and device for active reduction of audio acoustic noise.

BACKGROUND OF THE INVENTION

In order to ease the understanding of the descriptions and figures in the presentation of the present invention, an index of the used abbreviations is hereby given:

AAAS Ambient Audio Acoustic Signal
Ablock Acoustical channel's block
ADC (A/D) Analog to Digital Converter
ANC Active noise cancellation
ASYNC Acoustical SYNC
DAC (D/A) Digital to Analog Converter
DSP Digital Signal Processor
EA Electrical Audio Acoustic Signal
Eblock Electrical channel's block
ESYNC Electrical SYNC
FIR Finite Impulse Response
FxLMS Filter X LMS
GSM Generated Sequence Mark
GTT Generated Time Tag
Imic Inside Microphone
LMS Least Mean Square
QAAS Electrical Audio Acoustic Signal
QASYNC Quiet Acoustical SYNC
QEAAS Quiet Electrical Audio Acoustic Signal
QESYNC Quiet Electrical SYNC
RTC Real Time Clock
RTT Received Time Tag
Smic Singer Microphone
SNR Signal to Noise Ratio
SOF Start Of Frame
SYNC Synchronization Signal(s)
TEAAS Transmitted Electrical Audio Acoustic Signal
TESYNC Transmitted Electrical SYNC Active noise cancellation (ANC) is a specific domain of acoustic signal processing that intends to cancel a noisy signal by generating its opposite acoustic signal (referred to as "antiphase signal"). The idea of utilizing antiphase signals has gained considerable interest starting from the 1980s, due to the development of digital signal processing means.

The present invention is a method and system for active reduction of predefined audio acoustic signals emitted from a predefine source or sources in a predefined area of choice.

In order to relate to prior art and to explain and describe the present invention, the terms used in the text are hereby defined:

The invention is aimed to reduce predefined audio acoustic noise in predefined area or areas, referred hereafter as "quiet zone(s)", without reducing other ambient audio signals produced either inside or outside of the quiet zone(s), and without reducing any audio acoustic noise outside of the quiet zone(s). Inside the quiet zone(s) people experience substantially attenuation of the predefined acoustic noise, thus, able to converse, work, read or sleep without interference.

The "quiet zone(s)", refers in the context of the present invention interchangeably to a public and/or private areas, indoors and/or outdoors.

The predefined audio acoustic noise referred to in the present text, originates from a specified noise source such as, but not limited to, a mechanical machine, human voice (e.g. snores, talk) or music from an audio amplifier via a loudspeaker.

The term "acoustic" as defined by the Merriam Webster dictionary (http://www.merriam-webster.com/dictionary/acoustic) is: a) "relating to the sense or organs of hearing, to sound, or to the science of sounds"; b) operated by or utilizing sound waves. The same dictionary defines the term "sound" in context of acoustics as: a) particular auditory impression; b) the sensation perceived by the sense of hearing; c) mechanical radiant energy that is transmitted by longitudinal pressure waves in a material medium (as air) and is the objective cause of hearing. The same dictionary defines "signal" in the context of a "sound signal" as "a sound that gives information about something or that tells someone to do something" and in the context of electronics as "a detectable physical quantity or impulse (as a voltage, current, or magnetic field strength) by which messages or information can be transmitted". The term "audio" is defined by the Merriam Webster dictionary as: relating to the sound that is heard on a recording or broadcast. "Noise" in the context of sound in the present invention is defined as: a) a sound that lacks agreeable musical quality or is noticeably unpleasant; b) any sound that is undesired or interferes with one's hearing of something. The term "emit" is defined by the Merriam Webster dictionary as: "to send out". The same dictionary defines the term "phase" as: a) "a particular appearance or state in a regularly recurring cycle of changes"; b) "a distinguishable part in a course, development, or cycle". Thus "in-phase" means: "in a synchronized or correlated manner", and "out of phase" means: a) "in an unsynchronized manner"; b) "not in correlation". The term "antiphase" is logically derived and means: "in an opposite phase", which means synced and correlated, as in in-phase, but opposed in course/direction". Since acoustical wave is a movement of air whose direction alter back and forth rapidly, creating an antiphase acoustic wave means that the generated wave has the same direction-changes rate but in the opposite directions, and has same momentary amplitude.

The term MEL scale refers to a perceptual scale of pitches judged by listeners to be equal in distance from one another. In the context of this invention the MEL scale is used for calibrating the system.

FIR filter is an abbreviation for: Finite Impulse Response filter, common in digital signal processing systems, and is commonly used in the present invention LMS is an abbreviation for: Least Mean Square algorithm, used to mimic a desired filter by finding the filter coefficients that relate to producing the least mean squares of the error signal (the difference between the desired and the actual signal). In the present invention it is deployed by the system's computers to evaluate the antiphase. Some variations of such a filter are common in the field. FxLMS is the filter use in the present invention.

In the context of the present invention additional terms are defined:

The term "system" in reference to the present invention comprises the components that operate together forming a unified whole and are illustrated in FIGS. 5 and 6. The structure and function of the components is explained in detail further on in the text.

The term "Audio Acoustic Signals" is any acoustical audio signal in the air, whose source may be natural and/or artificial. In the context of the present invention, it refers to the non-predefined audio acoustics that need not to be reduced.

The term "Ambient Audio Acoustic Signals" is referred to in the present text as: "AAAS". Typically, AAAS can be generated by, but not limited to, a machine and/or human beings, and/or animals—as shown at FIG. 1; as a specific case example it can be music or other audio voices from audio amplifier, as shown at FIG. 2; and/or by other predefined acoustic noise source(s). In the present invention a single as well as a plurality of predefined AAAS directed towards (a) quiet zone(s) is/are referred to a as referred to interchangeably as "targeted AAAS" and "predefined acoustic noise". In the current invention, the predefined AAAS is/are the signal(s) to be reduced at the quiet zone(s) while the Audio Acoustic Signals are not reduced.

The term "acoustical distortion" means in context of the present text: the infidelity, or the misrepresentation of an acoustic signal at a specific location, in regards to its source, by means of its acoustical parameters such as: frequencies components, momentary amplitude, replications, reverberations, and delay.

The term "antiphase AAAS" in the context of the present text describes the precise momentary amplitude of the signal that opposes (negates) the original predefined AAAS as it actually arrives to the quiet zone, i.e. after it was acoustically distorted due physical factors. More specifically, the antiphase AAAS acoustical air pressure generated by the system at the quite zone is the negative acoustical air pressure originated by the predefined AAAS source, as it distortedly arrives to the quite zone. The present invention deals dynamically with this distortion.

Active canceling of predefined AAAS in a quiet zone is achieved by the acoustical merging of a targeted AAAS with antiphase AAAS. The canceling of the predefined AAAS by the antiphase AAAS is referred to interchangeably as "destructive interference".

In the present text the terms: "earphones" and/or "headphones" are interchangeably referred to as "Quieting Loudspeakers".

In the present invention antiphase AAAS is generated in the quiet zone(s) and broadcasted to the air synchronously and precisely in correlation with the predefined AAAS. This is done by using a unique synchronization signal, abbreviated as: SYNC.

Relating to prior art, presently there are commercial systems that generate antiphase signals in response to AAAS. These systems typically, but not exclusively, relate to headphones that include an internal microphone and an external microphone. The external microphone receives the AAAS from the surroundings and forwards the signal to a DSP (Digital Signal Processor) that produces appropriate antiphase AAAS that are broadcasted by a membrane inside the headphones. The internal microphone receives AAAS from within the confined space of the headphones and transmits it to the processing system as feedback to control and eliminate the residuals AAAS. Typically, headphones also provide an acoustic physical-barrier between the external AAAS and the internal space in the headphones. Also commercially available are systems that comprise an array of microphones and loudspeakers that generate antiphase AAAS in a relatively large area exposed to AAAS, thus, eliminating the AAAS penetrating a specific zone by creating a sound canceling barrier.

The advantage of the quieting Active Noise Cancellation (ANC) headphones" is the ability to control the antiphase signals to provide good attenuation of the received AAAS.

The disadvantage of "quieting ANC headphones" is the disconnection of the user from the surroundings. The wearer cannot have a conversation or listen to Audio Acoustic Signals while wearing the headphones. In addition, the ANC headphones mostly attenuate the lower frequencies of the audio spectrum, while the higher frequencies are less attenuated.

The quieting ANC headphones are mostly effective when AAAS is monotonous (e.g. airplane noise). When intending to achieve quiet with non-wearable equipment a complex array of microphones and loudspeakers is required for the sharp distinguishing, or barrier, between the noisy and quiet zones. The disadvantages are the high costs and large construction requirements.

In locations exposed to monotonous and repetitive AAAS, such as in, but not limited to, airplanes, refrigeration-rooms and computer-centers, the AAAS are typically characterized by limited frequency band in the range of up to about 7 KHz. Since in these cases the AAAS is frequency-limited, it becomes relatively easy to predict it, thus, to generate and broadcast appropriate antiphase AAAS in a designated quiet zone. This broadcast is done via loudspeakers, or, in specially designated headphones. Systems for the elimination of monotonous and repetitive AAAS or in low frequencies AAAS are available on the market.

Reference is presently made to AAAS in the context of the present invention:

Since AAAS (typically a combination of music and/or vocal acoustic signals) are difficult to predict, as they are non-stationary (i.e. typically not repetitive and they are typically cover large spectrum of human hearing ability, including high frequencies signals), it is not a simple task to generate a fully effective antiphase AAAS to achieve desired quiet zones. Typically, systems for creating quiet zones are limited to headphones. If a quiet zone is desired in a space significantly larger than the limited volume of the ear space (e.g. around a table, or at least around one's head), multi directional loudspeakers emitting the antiphase AAAS are required.

In order to substantially reduce AAAS whose source is located more than a few centimeters from a quiet-zone, the distortion of the AAAS due to its travel from the source to the quiet zone (the time-elapse for sound waves to spread through the air) has to be taken into account. The calculation to cancel the AAAS has so to fully adapt to the momentary amplitude, reverberations, frequency-response, and timing while broadcasting the antiphase AAAS. The present invention solves this problem and offers dynamic adaptation to environment's parameters, by on-line calculating the channel's behavior and response to a known stationary signal which is the SYNC.

Since the SYNC propagation in air has the same path as the undesired noise, it is possible to dynamically evaluate the distortion of the acoustical path, and the antiphase signal that is generated using SYNC distortion calculation.

In order to overcome the difficulties in precise correlation between the AAAS and the antiphase AAAS, various systems and methods have been disclosed, none of which have been fully successful in creating a distinct "quiet zone" in a distance of more than a few tens of centimeters from the source of the AAAS.

AAAS can be effectively eliminated at a distance of only a few tens of centimeters from its source, in a spatial volume having a narrow conical shaped configuration, originating from the AAAS source.

AAAS propagates in the environment in irregular patterns, not necessarily in concentric or parallel patterns, thus, according to prior art disclosed in U.S. Pat. No. 7,317,801 by Amir Nehemia, in order to reduce AAAS emitted by a single or several sources in a specific location, a single loudspeaker that emits antiphase acoustic signals is insufficient. Typically, the effective cancelation of incoming AAAS at a quiet zone requires the broadcasting of several well synchronized and direction-aimed antiphase acoustic signals to create an "audio acoustic protection wall".

To overcome the necessity of an "audio acoustic protection wall" which in many cases is ineffective or/and requires expensive audio acoustic systems, U.S. Pat. No. 7,317,801 discloses an active AAAS reduction system that directly transmits an antiphase AAAS in the direction of the desired quiet zone from the original AAAS source. The effect of Amir's AAAS reduction system depends on the precise aiming of the transmitted antiphase AAAS at the targeted quiet zone. The further away the quiet zone is from the source of the AAAS, the less effective is the aimed antiphase AAAS. The quiet zone has to be within the volume of the conical spatial configuration of the acoustic signal emitted from the antiphase AAAS source.

Amir's system comprises an input transducer and an output actuator that are physically located next to each other in the same location. In one embodiment, the input transducer and the output actuator are a hybrid represented by a single element. The active noise reduction system is located as close as possible to the noise source and functions to generate an "anti-noise" (similar to antiphase) cancellation sound wave with minimum delay and opposite phase with respect to the noise source. In order to overcome sound-delay and echo-effects, a transducer in an off-field location from the source of the AAAS receives and transmits the input to a non-linearity correction circuit, a delayed cancellation circuit and a variable gain amplifier. The acoustic waves of the canceled noise (the noise plus the anti-noise cancelation which are emitted to the surrounding) are aimed at or towards a specific AAAS source location, creating a "quiet zone" within the noisy area. If an enlargement of the quiet zone is required, several combined input transducer and an output actuator need to be utilized.

Most prior art systems refer to the reduction of the entire surrounding noise, without distinguishing between the environmental acoustic audio signals. The method and system of the present invention reduces noise selectively.

An example of a disguisable noise reduction system is disclosed in US 20130262101 (Sriram) in which an active AAAS reduction system with remote noise detector is closely located to the noise source and transmits the AAAS signals to a primary device where they are used for generating antiphase acoustic signals, thus reducing the noise. Thereby, acoustic signal enhancement in the quiet zone can be achieved by directly transmitting antiphase AAAS in the direction of the desired quiet zone from the original AAAS source.

The method and system of the present invention reduces noise selectively. I.e. only predefined audio acoustic noise is attenuated while other (desired) ambient acoustic audio signals are maintained. Such signals may be, not limited to, un-amplified speaking sounds, surrounding voices, surrounding conversations, etc. The method is based on adding synchronization signals over the predefined signal, both electrically and acoustically, thus distinguish the predefined signal from others.

SUMMARY OF THE INVENTION

The present invention of a method and system for active reduction of a predefined audio acoustic noise source utilizes audio synchronization signals in order to generate well correlated antiphase acoustical signal.

The method and system, illustrated in FIG. 5 in a schematic block diagram, utilizes the speed difference in which acoustic sound wave "travels" (or propagates) through air (referred to as the "acoustic channel") compared with the speed in which electricity and electromagnetic signals "travel" (transmitted) via a solid conducting substance, or transmitted by electro-magnetic waves (referred to as the "electric channel").

The precise correlation between the acoustic sounds that travels through air with the audio signal transmitted electrically is done by utilizing a unique synchronization signal(s), referred to interchangeably as "SYNC", that is imposed on the undesired audio acoustic noise signal, and is detectible at the quiet zone. The SYNC is used for on-line and real-time evaluation of the acoustical channel's distortions and precise timing of the antiphase generation. Since it is transmitted in constant amplitude and constant other known parameters such as frequency, rate, preamble data and time-tag, it is possible to measure the acoustical path's response to it. The use of the SYNC enables to evaluate acoustical environmental distortions that might appear due to echo, reverberations, frequency non-linear response, or due to other distortions mechanisms.

The present invention of a system and method for active reduction of a predefined audio acoustic noise by using SYNC relates to undesired audio acoustic noise that is generated and broadcasted by at least one predefined audio acoustic noise source such as noisy machine, or human voice or amplified audio such as music, towards a quiet zone or zones in which the specific undesired audio acoustic noise is attenuated. The attenuation is obtained by broadcasting antiphase signal, using loudspeaker(s) located in the quiet zone. The loudspeaker transmits the antiphase signal precisely in the appropriate time and with the appropriate momentary amplitude as the audio acoustic noise that arrives to the quiet zone. The precision is achieved by using the SYNC which is sent along with the undesired noise.

The interaction between the audio acoustic noise and the antiphase acoustic signal is coordinated by the SYNC that is present on both channels arriving to the quiet zone: electrically (wire or wireless) and acoustically (through air).
Since the acoustical channel is significantly slower than the electrical channel, it is possible to run all the necessary calculation prior the arrival of the acoustical signal to the quiet zone. Such calculations enable to filter out only the undesired audio acoustic noise signal by using antiphase audio acoustic signal as destructive interference, while not canceling other acoustic signals, thus, enabling people inside the quiet zone to converse with each other and also to converse with people outside of the quiet zone without being interfered of the undesired audio acoustic noise.

The present invention of a system for active reduction of a predefined audio acoustic requires that the predefined AAAS (also referred to as "predetermined noise") to be acquired by the system electronically. Illustrated in FIG. 3 and FIG. 4 are options for the electrically AAAS acquisition, (FIG. 3 for a typical case, FIG. 4 for a private case) from a predefined AAAS source. Illustrated in FIG. 1 and FIG. 2 are AAAS sources (FIG. 1 for a typical source, FIG. 2 for a private case). SYNC is generated by a unique signal generator and broadcasted to the air by a loudspeaker(s) placed in close proximity to the predetermined AAAS source in the direction of quiet zone via the "acoustic channel". The SYNC that combines in the air with the broadcasted predefined AAAS is designated Acoustical-SYNC (referring to as: ASYNC). Simultaneously, at the source-acquired predefined AAAS is converted to electrical signal, designated EAAS, and combined with electrically converted SYNC, designated Electrical SYNC (referred to as: ESYNC). The combined EAAS+ESYNC signal is transmitted electrically via wireless or a wired "electrical channel" to a receiver in the quiet zone.

The combined ambient acoustical signal predetermined AAAS+ASYNC and the surrounding acoustical undefined noise are acquired by the system in a quiet zone by a microphone. The signal, abbreviated as "TEAAS+TESYNC" (the addition of the "T" for "transmitted") derived from the electrical channel is received at the quiet zone by a corresponding receiver.

Both the acoustical and the electrical channels carry the same digital information embedded in the SYNC signal. The SYNC digital information includes a timing-mark that identified the specific interval they were both generated at. The identifying timing-mark enables to correlate between the two channels received in the quiet zone, The time difference, in which both channels are received in the quiet zone, makes it possible to accurately calculate, during the delay time, the exact moment to broadcast the antiphase acoustic signal.

The antiphase signal is generated on the basis of the electrically-acquired predetermined AAAS, and considers the mentioned delay and the channel's distortion function characteristics that were calculated on-line. FIG. 11 illustrate the closed loop mechanism that converges when the predefined AAAS is substantially attenuated. The calculation algorithm employs adaptive FIR filter, W(z), that operates on the ASYNC signal (SYNC[n] in FIG. 11), whose parameters update periodically by employing FxLMS (Filtered X Least Mean Square) mechanism, such that the antiphase signal causes maximum attenuation of the ASYNC signal as received in the quiet zone. $\hat{y}[n]$. Illustrated in FIG. 11 is the algorithm outcome which is almost equal to y[n], where y[n] represents the surrounding undefined noises. $\hat{Y}[n]$, though, has almost no x[n] residuals. Since the SYNC signal is distributed over the audio spectrum, the same filter is assumed for predefined AAAS as the channel's distortion, while generating the antiphase AAAS.

The synchronization signal has such amplitude, duration and appearance rate so it will not be acoustically heard by people at the entire AAAS broadcasted area, including the quiet zone(s). This is achieved by dynamically controlling the SYNC signal's amplitude and timing, so minimal SNR between the SYNC signal amplitude and the predefined AAAS amplitude makes it possible to detect the SYNC signal. The term "SNR" refers to Single to Noise Ratio and is the ratio, expressed in db, between two signals, where one is a reference signal and the other is a noise.

Periodic and continuous updating and resolving of the SYNC signal ensures precise generation in time and momentary amplitude of the antiphase signal in the quiet zone, thus, maximizing the attenuation of the undesired audio acoustic noise in the quiet zone. Additionally, the periodic and continuous updating and resolving of the SYNC signals significantly improves the undesired acoustic noise attenuation in the high-end of the audio spectrum, where prior art "quieting-devices" are limited. It also adapts to dynamic environments where there is movements around the quiet zone that affect the acoustical conditions, or where the noise source or the quiet zone vary in their relative location.

For the active reduction of undesired predefined AAAS in accordance with the present invention, the quieting loudspeakers can have various configurations, shapes, intended purposes and sizes, including headphones and earphones.

The invention enables to utilize several quiet zones simultaneously. This requires duplication of an amplifier, a quieting loudspeaker and at least one microphone for each additional quiet zone.

The invention enables a quiet zone to dynamically move within the area. This is achieved inherently by the synchronization repetitive rate.

A BRIEF DESCRIPTION OF THE DRAWINGS

In order to better understand the present invention, and appreciate its practical applications, the following figures & drawings are provided and referenced hereafter. It should be noted that the figures are given as examples only and in no way limit the scope of the invention. Like components are denoted by like reference numerals.

FIG. 1 schematically illustrates a Typical case in which the predefined AAAS is emitted directly from the noise source.

FIG. 2 schematically illustrates a private case where the predefined AAAS is emitted indirectly from a commercial amplifying system in which a loudspeaker is used as the noise source.

FIG. 3 schematically illustrates the merging of electrical SYNC signal converted to acoustical SYNC signal, with predefined AAAS, where the predefined AAAS is emitted directly from the noise source.

FIG. 4 schematically illustrates the merging electrical SYNC signal converted to acoustical SYNC signal, with predefined AAAS, where the predefined AAAS is emitted from an amplifying system.

Figure 9:
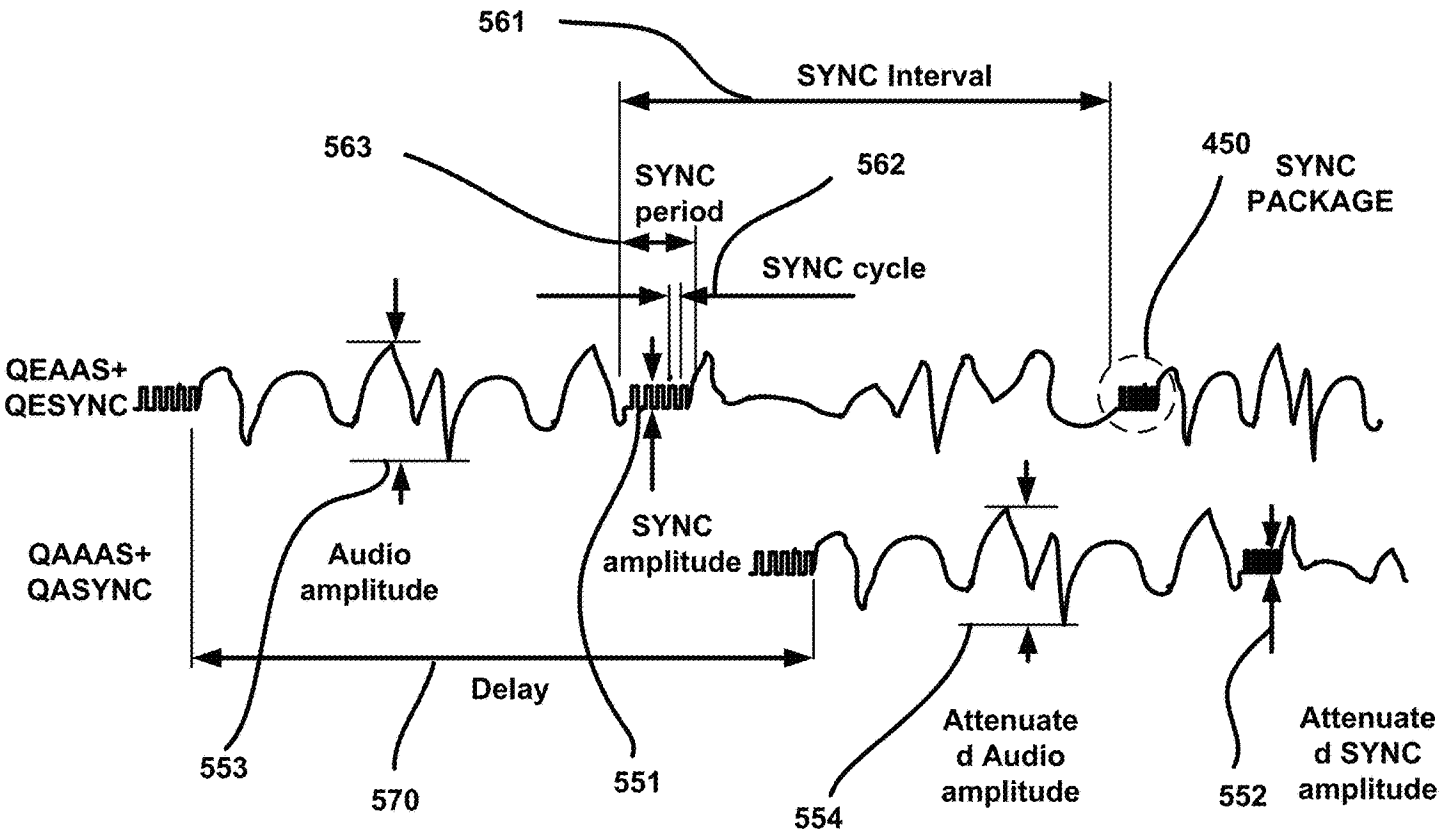

FIG. 9 schematically illustrates the physical characteristic of a typical SYNC.

Figure 10:
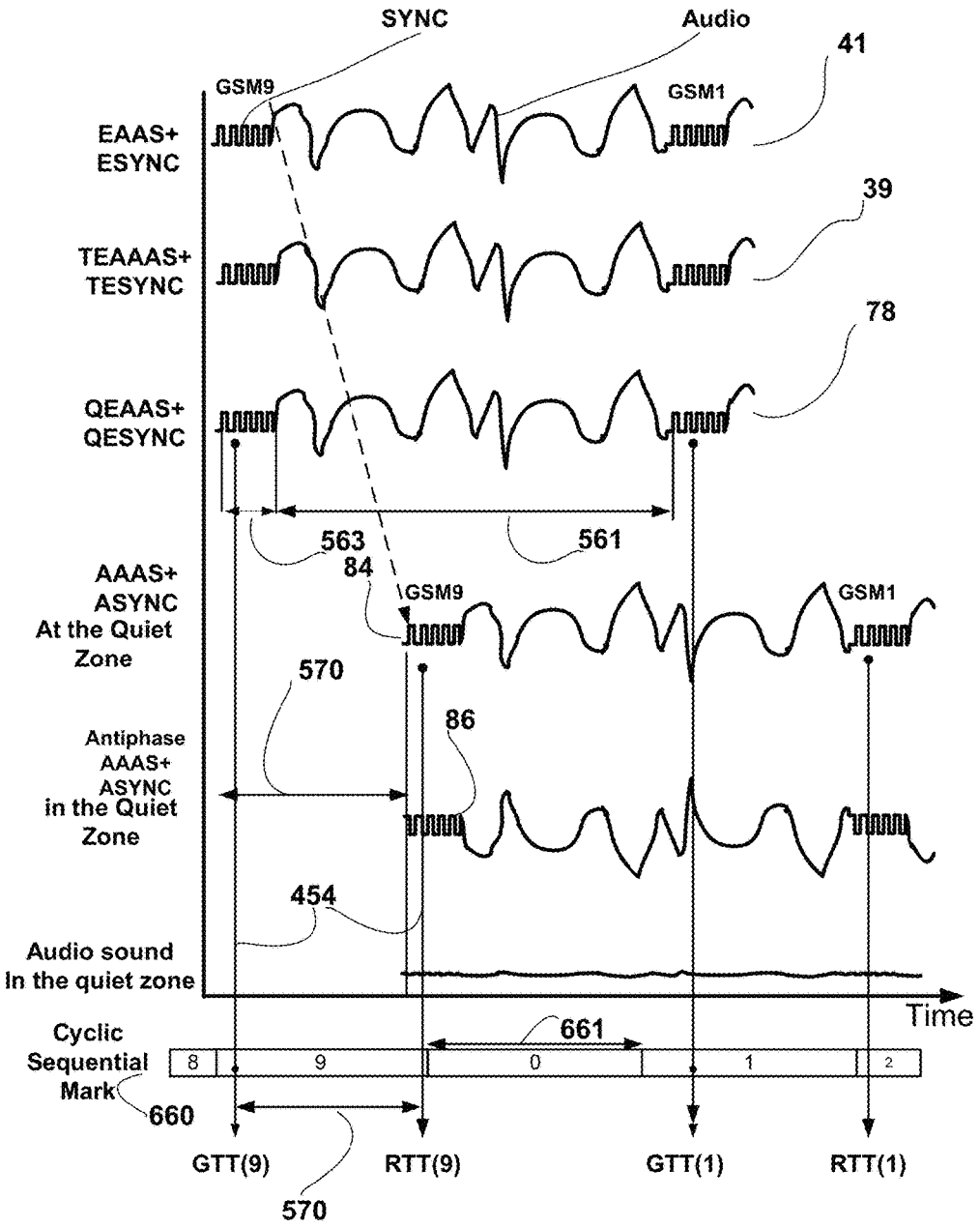

FIG. 10 is a graphical illustration of the major signals propagation throughout the system within a time interval.

Figure 11:
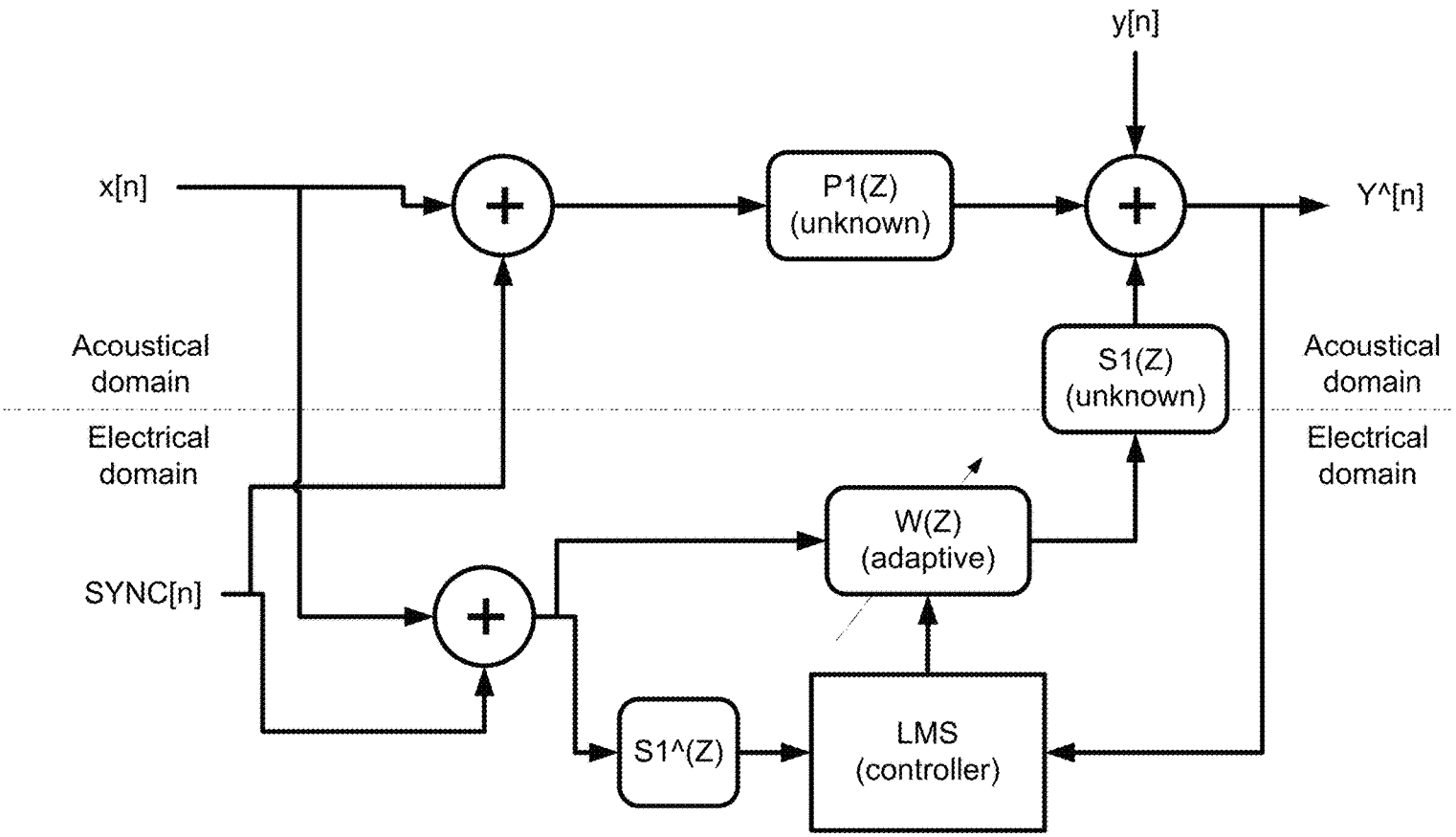

FIG. 11 illustrates the algorithmic process that the system of the present invention employs, considering the acoustical domain and the electrical domain.

DETAILED DESCRIPTION OF AN EMBODIMENT OF THE INVENTION

Figure 5:
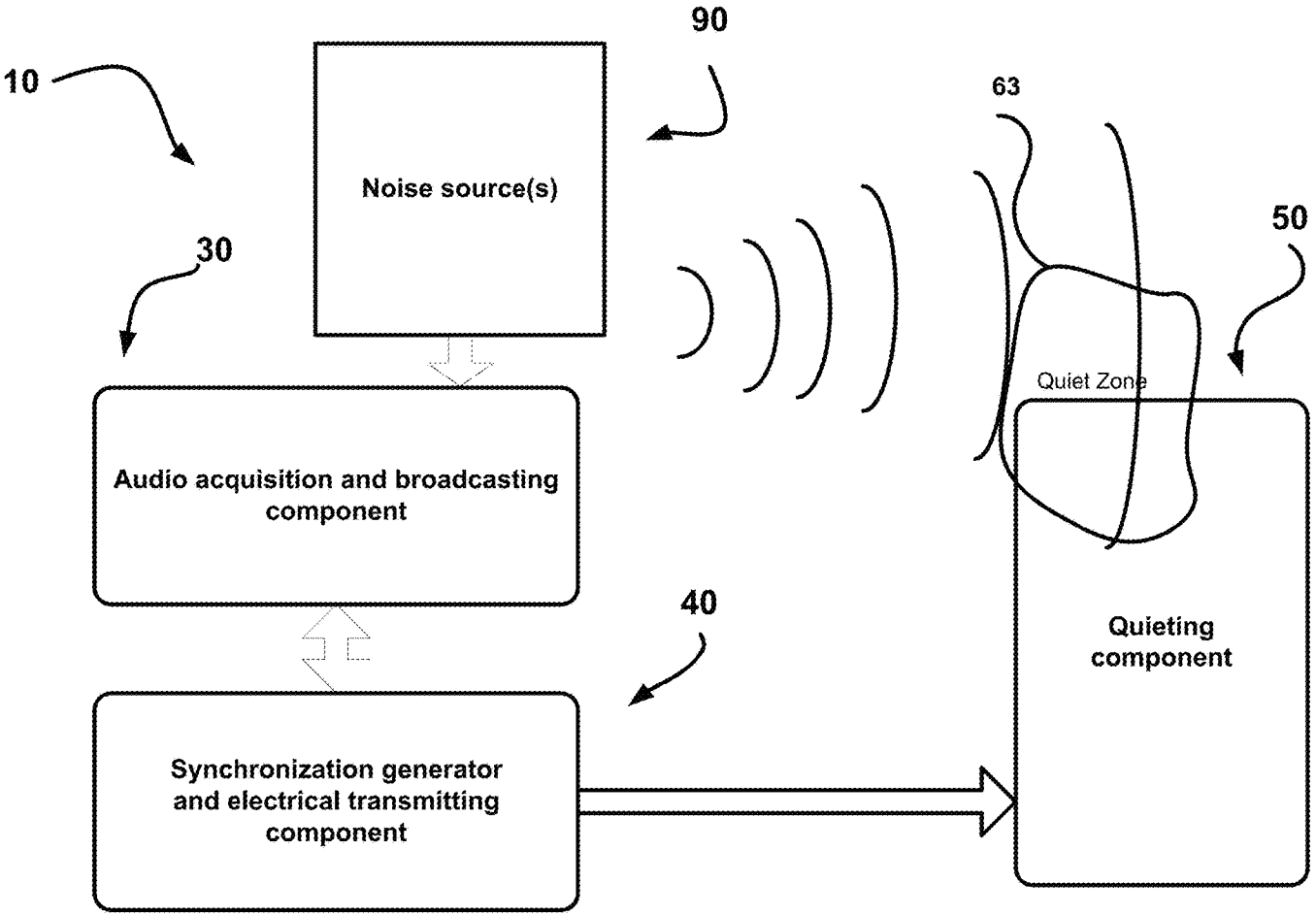
FIG. 5 is a block diagram that illustrates the major components of the method and system of the present invention, for active reduction of a predefined AAAS and their employment mode relative to each other.

FIG. 5 illustrates schematically the major components of a system and method (10) for active reduction of an audio acoustic noise signal of the present invention and their employment mode relative to each other. The figure illustrates the three major components of system: 1) an audio Multiplexing and Broadcasting component (30); 2) synchronization and transmitting component (40); and 3) a quieting component (50). A detailed explanation of the three major components of the system (10) is given in FIG. 6. The structure and usage of the synchronization signal, referred to as "SYNC signal", is given further on in the text, as well as analysis of the SYNC employment algorithm.

The method and system of the present invention is based on generating antiphase signal which is synchronized to the predefined noise, by using dedicated synchronization signals, referred in the present text as "SYNC". The SYNC signals are electrically generated (38), and then acoustically emitted through air while being combined with the predefined noise acoustic signal (AAS). Both the predefined noise and the acoustical SYNC (84)—among other acoustic sounds that travels through air—are received at the quiet zone, where the SYNC signal is detected. Simultaneously, the SYNC signal is electrically combined with the acquired predefined noise signal (41), and electrically transmitted to the quiet zone, where again the SYNC signal is detected. The SYNC signal detected at each of the two channels synchronizes an antiphase generator to the original predefined noise, to create a quite zone(s) by acoustical interference.

Figure 6:
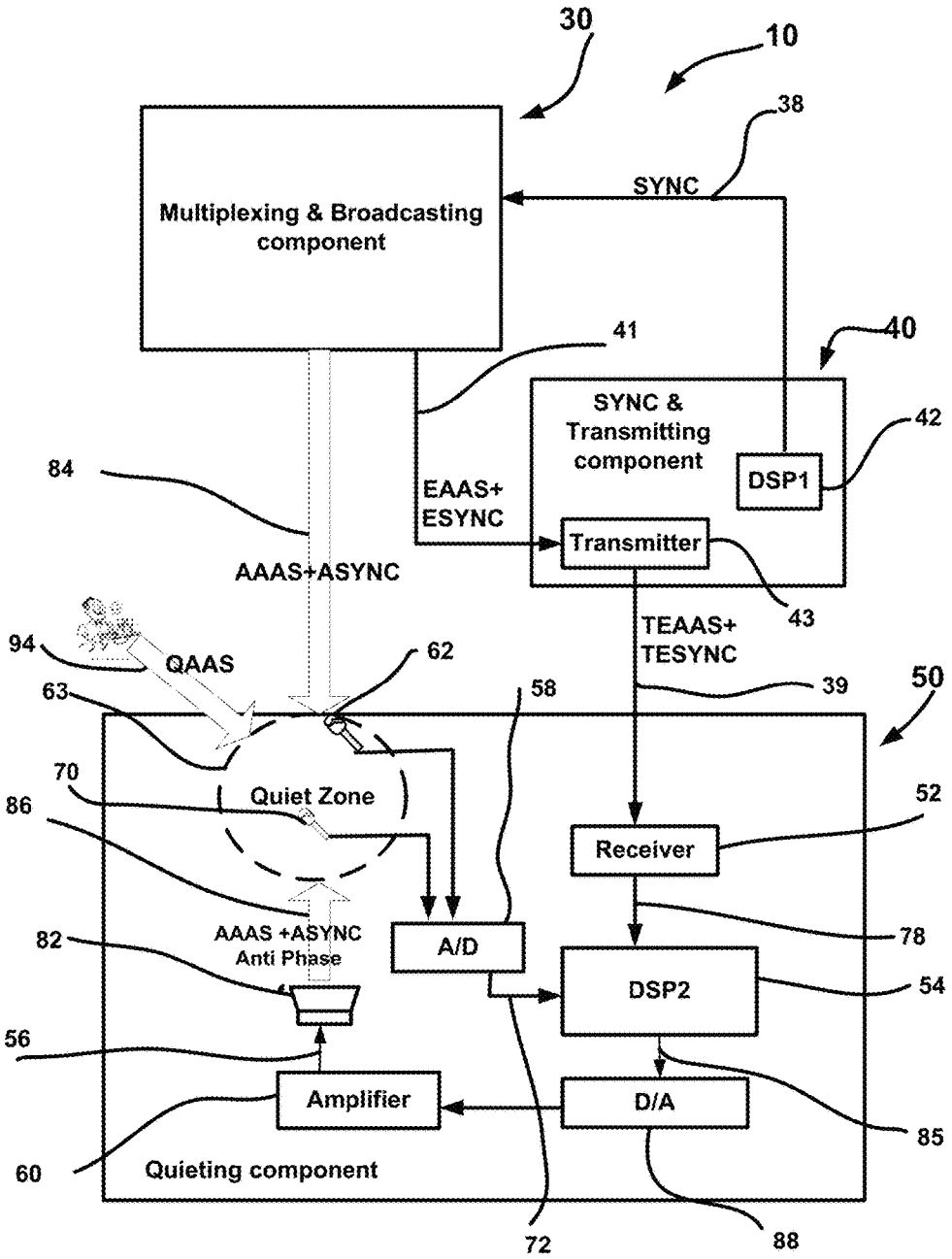
FIG. 6 is a detailed schematic presentation of an embodiment of the system of the present invention, where the predefined AAAS is acquired by the multiplexing and broadcasting component in either configuration shown in FIG. 1 or FIG. 2.

FIG. 6 is a schematic graphical illustration of embodiments of the employment of system (10) for the active reduction of the predefined audio acoustic noise (91).

Figure 1:
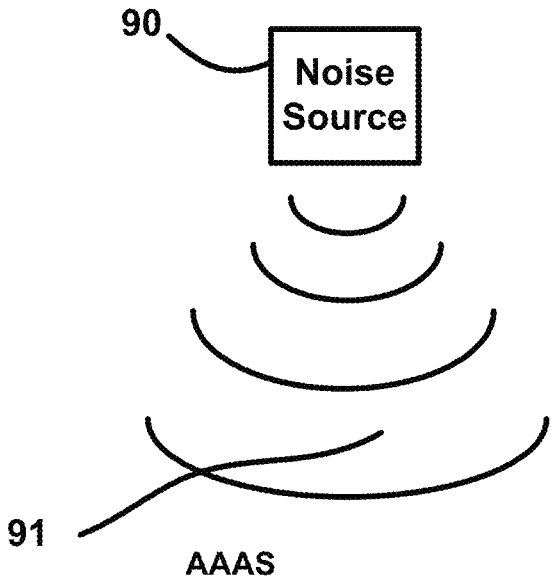
Figure 2:
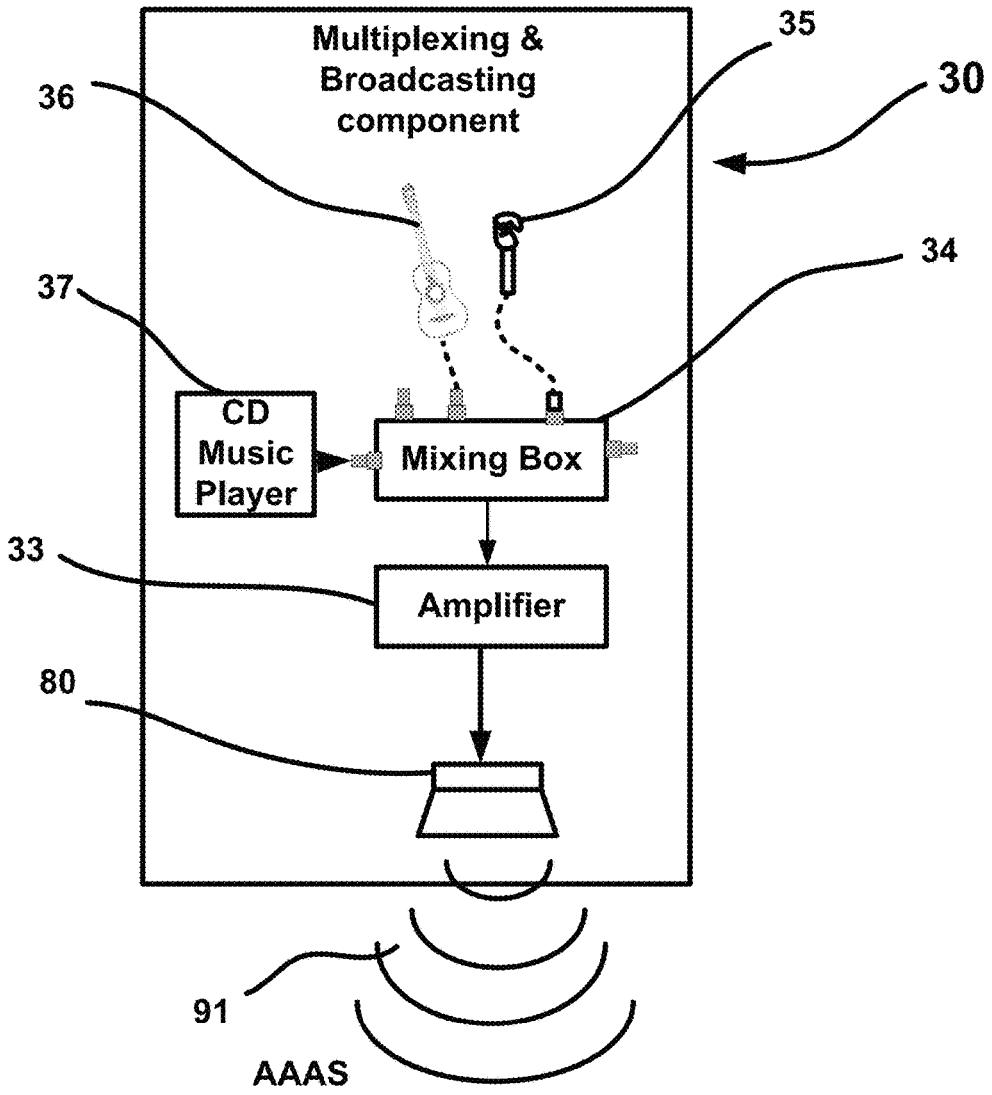

Reference is presently made to explaining various components that comprise the three major component units (30), (40) and (50) comprising the system of the present invention, presented in a block diagram in FIG. 5:

The audio Multiplexing and Broadcasting component (30) is typically a commercially available amplifying system, that, in the context of the present invention, comprises:
(1) A signal "mixing box" (34) which combines individual electrical audio-derived signals inputs (35, 36, 37 shown in FIG. 2 and FIG. 4). The mixing box has a reserved input for the SYNC signal, which routed to (at least) one electrical output component;
(2) An optional microphone (32);
(3) An audio power amplifier (33);
(4) A loudspeaker(s) (80 or 81) shown in FIG. 3 and FIG. 4;

The synchronization and transmitting component (40) comprises:
(1) a digital signal processor, referred to as DSP1 (42);
(2) a wired or wireless transmitter (43);

The quieting component (50) comprises:
(1) A microphone, referred to as Emic, designated in the figures as: (62), preferably located at the edge of the quiet zone (63);
(2) An optional second microphone, referred to as Imic, designated in the figures as: (70), which is located in the quiet zone (63) preferably in its approximate center;
(3) A transducer (a digitizer which is an analog to digital converter) (58);
(4) A wire or a wireless receiver (52), that corresponds to the transmitter (43);
(5) A digital signal processor, referred to as: DSP2 (54);
(6) A transducer (a digital to analog converter) (88);
(7) An audio amplifier (60);
(8) A loudspeaker used as a quieting loudspeaker (82) that broadcasts the antiphase AAAS.

With the exception of the following: microphone Emic (62); the quieting loudspeaker (82); and the optional second microphone (Imic) (70)—all the subcomponents comprising the quieting component (50) do not necessarily have to be located within or close to the quiet zone (63).

In cases where more than a single quiet zones (63) is desired, each of the zones has to contain the following: a microphone Emic (62); a quieting loudspeaker (82); and, optionally, also a microphone Imic (70).

Presently the mode of operation of the system (10) for the active reduction of predefined AAAS of the present invention is described. The mode of operation of the system (10) can be simultaneously applicable to more than a single quiet zone.

Figure 7:
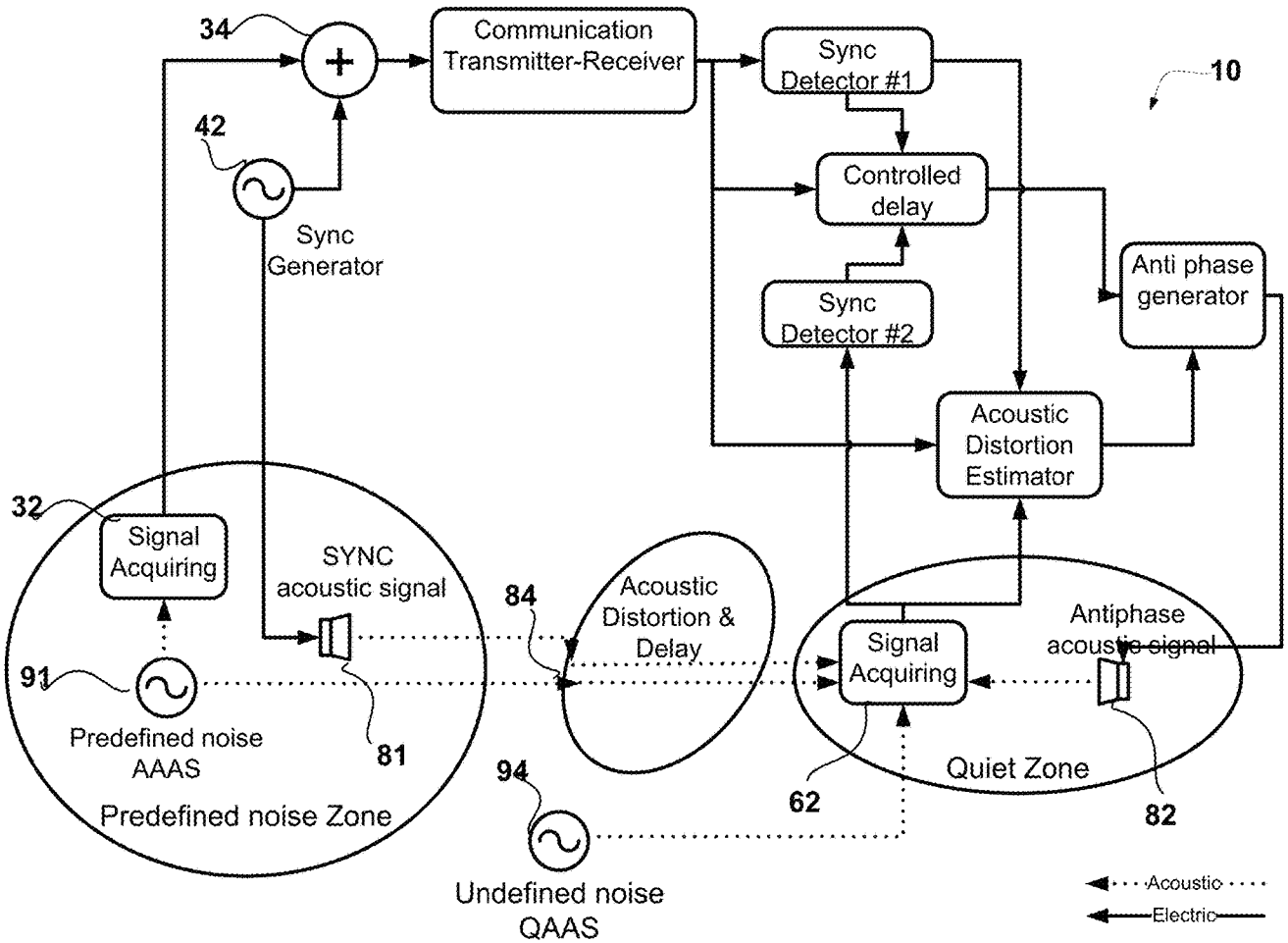
FIG. 7 is a functional block diagram that illustrates major signal flow paths between the major components (illustrated in FIG. 5) of the system (with emphasis on the SYNC) of the present invention.

The precision of the matching in time and in amplitude between the AAAS and the antiphase AAAS in the quiet zone is achieved by using unique synchronization signal that is merged with the AAAS acoustic and electric signal. The synchronization signals are interchangeably referred to as SYNC. The SYNC has two major tasks: 1) to precisely time the antiphase generator; and 2) to assist in evaluating the acoustical channel's distortion. FIG. 7 shows the functional diagram of the system.

For describing the system's (10) mode of operation, as illustrated in FIG. 6, focus is first turned for explaining the SYNC (38) signal characterization, processing and routing. FIG. 7 is (also) referred to explain the use of the functional-use of SYNC.

As Illustrated in FIG. 6 the SYNC signal (38) is generated by DSP1 (42) that resides in the synchronization and transmitting component (40). It is transmitted toward the mixing box (34) that resides in the audio multiplexing and broadcasting component (30). The SYNC has such physical characterization that contains specific information as described in context of the description given for FIG. 8 and FIG. 9 hereafter.

Figure 8:
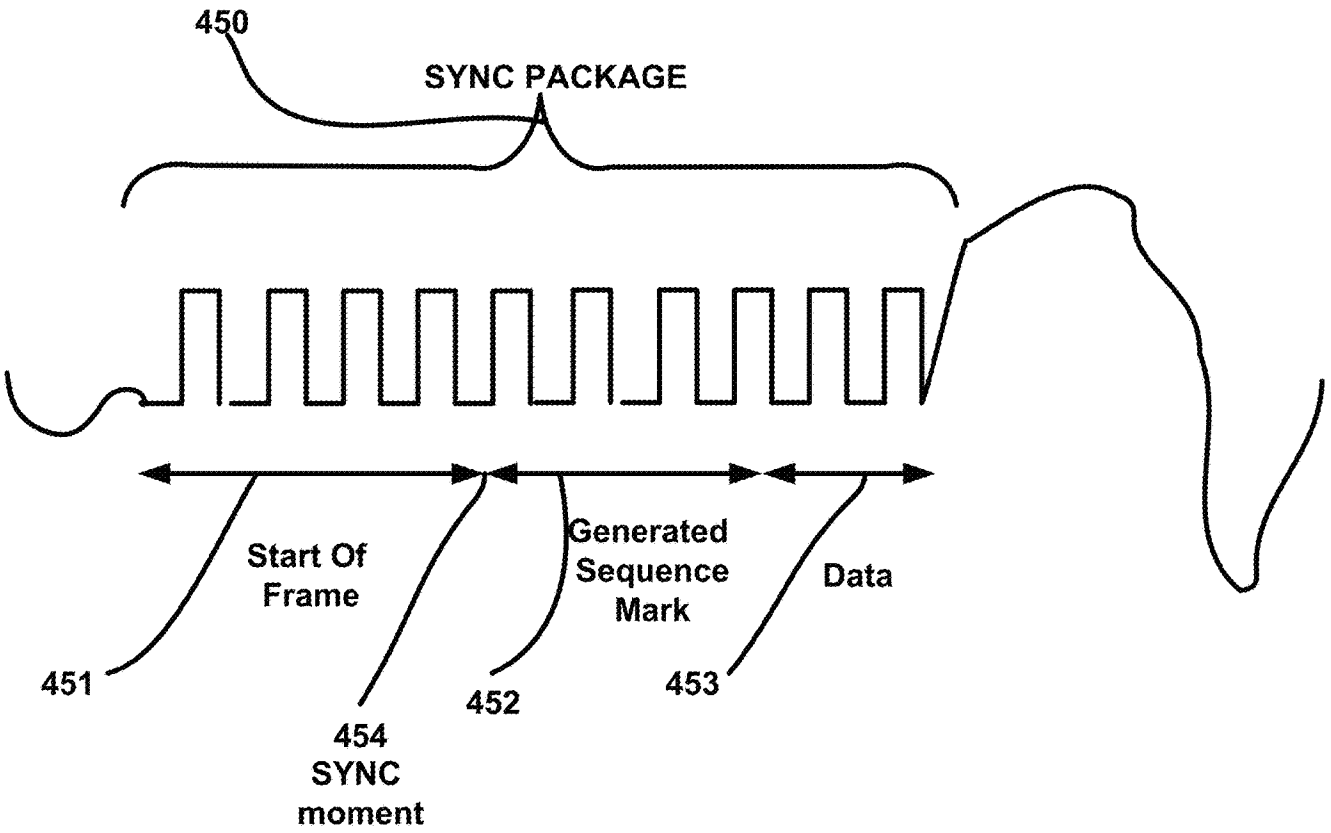
FIG. 8 illustrates schematically a basic structure of typical a "SYNC package".

Definitions related to the SYNC signal(s) (38), illustrated in FIG. 8 and FIG. 9, are presently presented:

The SYNC generating system employs two clocks mechanisms: 1) a high resolution (e.g. ~10 microseconds, not limited) Real Time Clock, that is used to accurately mark system events, referred to as RTC; and 2) a low resolution (e.g. ~10 milliseconds, not limited) free cyclic counter with ~10 states (not limited), referred to as Generated Sequential Counter.

A SYNC signal has the following properties, as shown in FIG. 9:
1) Constant amplitude (551)—is the value used as a reference for resolving signals attenuation (552, 554);
2) Constant interval (561) is the time elapse between two consecutive SYNC packages (repeat rate of about 50 Hz, not limited). This rate ensures a frequent update of the calculation. A constant rate will also be used to minimize the effort of searching for SYNC signal in the data stream;
3) A single (or few more; not limited) cycle of a constant frequency, thus called a SYNC cycle (562) (e.g. about 18 KHz; cycle of about 55 microseconds, not limited).

Few SYNC cycles are present during the SYNC period (563), approximately 500 microseconds, not limited, per each time interval. This constant frequency is used for detection of the SYNC signal. Nevertheless, the constant frequency may vary among the SYNC intervals, to enable acoustic channel's dynamic calibration of the acoustic and electric response over the frequency spectrum.

When the amplitude of a SYNC cycle is zero—the binary translation is referred to as binary '0'; when the amplitude of the SYNC cycle is non-zero—the binary translation is referred to as binary '1'. This allows to code data over the SYNC signal. Other methods of modulating the SYNC may be used as well.

FIG. 8 schematically illustrates a typical "SYNC package" (450) which information carried by the SYNC signal, within the SYNC period (563). A SYNC package contains, but is not limited to, the following data by digital binary coding:

1) a predefined Start Of Frame pattern (451) referred to as SOF, that well defines the beginning of the package's data;
2) a Generated Sequence Mark (452), referred to as: "GSM", which is a copy of the Generated Sequential Counter at the moment that SYNC signal has been generated originally for the specific package,
3) additional digital information (453), such as SYNC frequency value and instruction-codes to activate parts of the "quieting system", upon request/need/demand/future plans.

Focus is now turned to the SYNC signal flow description:

FIG. 10 illustrates an example of employing a SYNC package (450) over AAAS, and demonstrates the signal(s) flow in a system where AAAS source (marked 91 at FIG. 3 and at FIG. 4) propagates to the quiet zone (63) and arrives after delay (570).

Typically, the combined electrical signal (41) flows through the transmitter and the receiver as a transmitted signal. The transmitted signal, abbreviated as TEAAS+TESYNC and designated (39), is received at the quiet zone relatively immediately as QEAAS+QESYNC signal (78). The term "QEAAS+QESYNC" refers to the electrically received audio part (QEAAS) and the electrically received SYNC part (ESYNC) in the quiet zone. The predefined AAAS+ASYNC acoustic signal (84) is slower, and arrives to the quiet zone after the channel's delay (570). This is the precise time that the antiphase AAAS+ASYNC (86) is broadcasted.

Focus is now turned to the digital binary data identification:

Separating the SYNC package (450) from the combined signal starts by identifying single cycles. This is done by using a narrow band pass filter centered at SYNC frequency (562). The filter is active at the SYNC time period (563) within the SYNC time interval (561). When the filter crosses a certain amplitude level relative to the SYNC constant amplitude (551), binary data of '1' and '0' can be interpreted within this period. After binary data is identified, a data-structure can be created, as illustrated in FIG. 8: SOF (451) may be considered as, but not limited to, a unique predefined binary pattern uses to identify the start of the next frame, enabling to accumulate binary bits and thus create the GSM (452) and the data (453).

The system copies the moment of detecting the end of the SOF (451). This moment is recorded from the RTC and is used to precisely generate the antiphase. This moment is defined in the present text as "the SYNC moment" (454) as shown in FIG. 8.

Separating the predefined AAAS from the combined signal is done by eliminating the SYNC package (450) from the combined signal by using a narrow band stop filter during the SYNC time period (563), or by other means.

The SYNC moment at each of the two received channels (the acoustical and electrical) is resolved, and attached to the corresponding block, as shown in FIG. 10 (see the identification of GTT and RTT). The attaching action is called Time Tagging. The Sync moment of each of the channels is called Received Time Tag, abbreviated as RTT. Since the transition through the electrical channel is fast, it is reasonable to assume that the Generated Time (GTT) is almost equal to RTT of the electrical channel.

In order to find and define the acoustical channel's distortion and to generate the antiphase AAAS, the system, its algorithm illustrated in FIG. 11, logically changes its state among the following four states:

(1) Calibration of the secondary paths state. This is an off-line initial calibration state, during system installation and in as sterile (undisturbed) environment as possible, i.e. no predefined noise is active and no other noise as well, as much as possible. In this state, the acoustic channel's distortion is calculated by generation white noise and by generating SYNC signal from the loudspeakers. Then receive them by the microphones. This state intends to resolves the system's secondary paths, marked S1($z$).

(2) Validation of the secondary paths estimation. It is an off line fine calibration state, used to validate the initial calibration, and also done as sterile as possible. The system tries to attenuate SYNC signals only (no AAAS) with the previously calculated FIR, while using the estimated secondary path, marked $\hat{S}(z)$. If the attenuation has not succeeded than the system tries to calibrate again with higher FIR order.

(3) On-line state, called Idle State. This state intends to resolve the primary path distortion, while the system is already installed and working; the SYNC signal has relatively low amplitude and still SNR (SYNC signal relative to the received signal (72) at the quiet zone) is above certain minimum level. In this state, the SYNC signal component of the combined predefined AAAS+ASYNC signal (84) is used to adapt the distortion function's parameters, referred to as: P1($z$), i.e. the system is employing its FxLMS mechanism to find the FIR parameters W(z) that minimize the SYNC component of the combined signal. The idea is that the same filter shall likely attenuate the predefined AAAS component of the combined signal. The system uses this FIR to generate the antiphase AAAS signal. When the SNR degrades or when SYNC signal is not detected than the system moves to Busy state.

(4) On-line state, called Busy State where the system is already installed and working, and the acoustic channel's distortion W(z) is known from the previous states. The SNR (SYNC signal relative to the received signal (72) at the quiet zone) is low, so the system uses the last known FIR to generate the antiphase AAAS signal. Additionally, the system increases the SYNC signal to regain the minimal required SNR, thus move to Idle state.

While off line, i.e. while the system is not yet in use, it needs to undergo calibration procedure of the secondary paths, marked S1($z$) in FIG. 11: DSP2 generates white noise by the quieting loudspeaker (82), instead of antiphase AAAS+ASYNC (86), which is received by the microphone (62) at the quiet zone. Then DSP1 and DSP2, respectively, analyze the received signals and produce the secondary acoustical channel's response to audio frequencies.

The calibration procedure continues in the fine calibration state, described earlier, in order to validate the calibration. The validation is done where well defined SYNC signal (38) is generated by DSP2; broadcasted by loudspeaker (82) and received at the quiet zone by microphone (62), as described earlier. Several frequencies, e.g. MEL scale, are deployed At the quiet zone, DSP2 as the FxLMS controller regarded in FIG. 11, updates the model of the acoustical channel W(z) (e.g. based on FIR filter), by employing FxLMS mechanism, where the broadcasted signals are known and expected. The signal to minimize is QAAS+QASYNC (72). When the minimization process is at a required level it means that the difference between a received signal and the system's output on the quieting loudspeaker (82) is minimal, thus the filter estimated the channel with high fidelity.

In Idle state, SYNC signal is transmitted in relatively low amplitude, while antiphase AAAS signal is generated to interfere with the predefined AAAS as received at the quiet zone. The FIR parameters, W(z), are continuously updated by using the FxLMS Mechanism to minimize the residual of the ASYNC (83) by its antiphase. In this on-line state, predefined AAAS flows through the filter whose parameters are defined by the SYNC signal, thus, generating antiphase both to the predefined AAAS and to the SYNC. When no SYNC is detected by DSP2, or, SNR (of the SYNC relative to the received signal) degradation is observed (by means of SYNC cancelation) the updating holds, and the system moves to Busy state. The system shall re-enter Idle state when the SNR rises beyond a certain threshold again.

In Busy state, SYNC signal is transmitted in relatively low amplitude. In this state the system generates antiphase by using the acoustic channel's distortion parameters W(z), as recently calculated.

The current FIR parameters are used for the active noise cancelation

Figure 3:
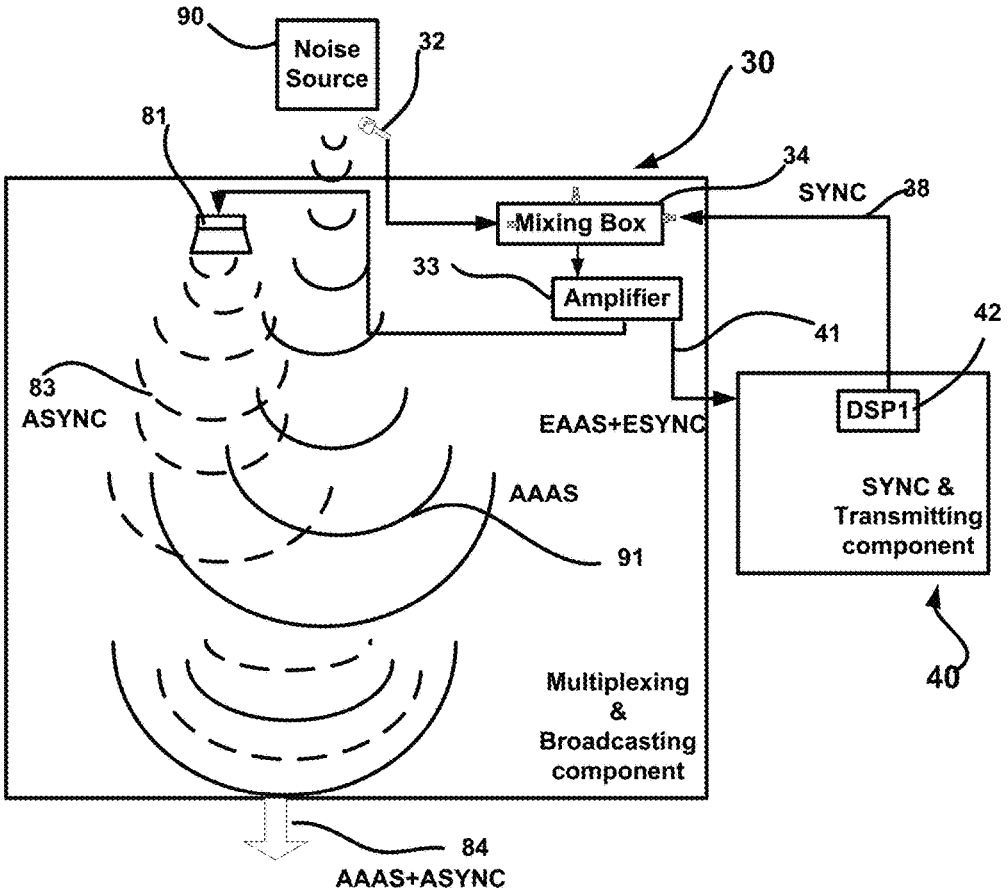
Figure 4:
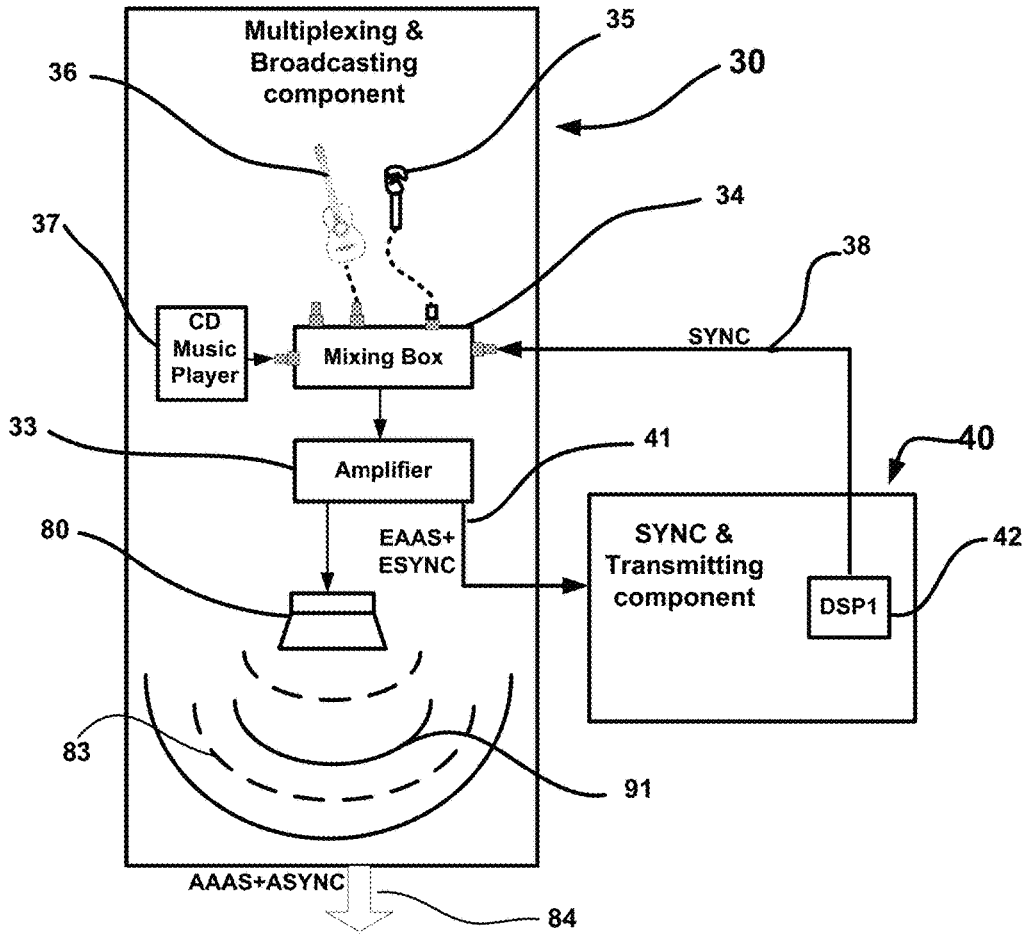

Focus is now turned to the flow of the SYNC signal along with the predefined AAAS, until the antiphase is precisely generated:

The predefined AAAS is digitally acquired into the system, thus converted to electrical signals. This is done by positioning a microphone (32) as close as possible to the noise source (90) as shown in FIG. 3, or directly from an electronic system as shown in FIG. 4. In either case—the acquired predefined AAAS is referred to as EAAS.

The electrically converted noise signals referred to as EAAS are integrated in the "mixing box" (34) with SYNC signal (38). The integrated signals are amplified by amplifier (33). The Integrated electrically converted signals are referred to as "EAAS+ESYNC" (41).

As mentioned earlier, the SYNC signal (38) generated by DSP1 (42) at the SYNC and transmitting component (40), is converted to acoustic signal, referred to as: ASYNC (83). ASYNC (83) is amplified by an audio amplifier (33) and broadcasted in the air by either, but not limited to, a dedicated loudspeaker (81) as shown in FIG. 3, or by a general (commonly used) audio system's loudspeaker (80) as shown in FIG. 4. In both cases (shown in the Figures) the acoustic signal ASYNC (83) and the AAS (91) are merged in the air. The merged signals are referred to as AAAS+ASYNC (84). On the way to the microphone Emic (62) in the quiet zone, the merged signals (84) are distorted by P1(*z*) as shown in FIG. 11. The merged signals (84) are the ones that the signal from the quieting loudspeaker (82) cancels.

While AAAS+ASYNC (84) leaves the Multiplexing and broadcasting component (30), together with negligible time difference, the combined signal EAAS+ESYNC (41) is forwarded to the transmitting component (43), which transmits it either by wire or by wireless method toward a corresponding receiver (52) in the quieting component (50).

The electrically transmitted signal TEAAS+TESYNC (39) is a combination of the audio information electrically transmitted AAAS, referred to as "TEAAS", and the SYNC information electrically transmitted, referred to as "TESYNC".

The electrical channel is robust, thus, data at the receiver's output (78) received exactly as data at the transmitter's input (39) with no loss and no further distortion, and with negligible delay.

In the quieting component (50) the receiver (52) forwards the integrated signals, referred as QEAAS+QESYNC (78), to DSP2 (54).

DSP2 (54) executes a separation algorithm whose input is the combined signal QEAAS+QESYNC (78) and its output are two separate signals: QEAAS and QESYNC.

At this point DSP2 (54) saves the following in its memory:

1) GSM (452) as it appeared in QESYNC package, as shown in FIG. 8;

2) RTT which is the accurate time that the specific QESYNC's (78) package has been received by DSP2;

3) QEAAS data (453) as shown in FIG. 8.

The three elements together are referred to as an "Eblock". DSP2 (54) stores the Eblock in its memory.

In the quieting component (50) the microphone EMIC (62), positioned at the edge of the quiet zone (63), acquires the acoustical signal at the quiet zone vicinity. This signal is comprised of the AAAS+ASYNC (84) signal, distorted by the acoustic channel, and also of the surrounding voices in the quiet zone vicinity, referred to as QAAS signal (94) shown in FIG. 6. In FIG. 11 that describes the algorithm deployed in this invention, the SYNC signal is represented as SYNC(n); the undesired noise is represented as x(n); the surrounding voices QAAS are represented as y(n); and $\hat{y}(n)$ represents the surrounding voices that may be distorted a little due to residual noises.

The acquired integrated signals, referred as QAAS+QAAS+QASYNC (72), and forwarded to DSP2 (54).

DSP2 (54) executes a separation algorithm whose input is the combined signal QAAS+QAAS+QASYNC (72). This is the same separation algorithm as was previously described regarding QEAAS and QESYNC processed on the combined signal QEAAS+QESYNC (78) coining from receiver (52). At this point its output is two separate signals: QAAS+QAAS and QASYNC.

At this point DSP2 (54) saves the following in its memory

1) GSM (452) as appears in QASYNC package as shown in FIG. 8;

2) RTT which is the accurate time that the specific QASYNC's (72) package has been received by DSP2.

3) QAAS+QAAS data (453), as shown in FIG. 8.

The three elements together are referred to as an "Ablock". DSP2 (54) stores the Ablock in its memory.

DSP2 (54) executes a correlation algorithm as follows: DSP2 takes the GSM written at the most recent Ablock and searches in the memory for an Eblock having the same GSM. This is in order to locate two corresponding blocks that represent the same interval but with delay.

DSP2 then extracts QEAAS data from Eblock.

DSP2 uses the recent acoustical channel's RTT, in order to time the antiphase generator with Eblock's data, as shown in FIG. 7.

DSP2 (54) continuously calculates the acoustic channel's response to the repetitive SYNC signal, as described earlier in Idle state.

Since the Eblock that is stored in the memory enough time before DSP2 needs it for its calculations; and since the FIR filter, represented as W(z) in FIG. 11, is adaptive; and since the secondary channel path S1(*z*) is known; and since the precise moment to transmit the antiphase DSP2 is known; thus, it is possible to accurately and precisely generate the acoustical antiphase AAS.

After de-digitize the signal, by using a DAC converter (88) and amplify (56), is forwarded toward the loudspeaker (82). This signal has the precise calculated delay (as was previously explained) i.e. the antiphase signal will be broadcasted just at the appropriate moment with the incoming AAAS+ASYNC (84) acoustics signal as heard at the edge of the quiet zone and as shown in FIG. 6.

The process that was described above is repeated sequentially for every block, i.e. for each SYNC interval (561) shown in FIG. 9, thus, ensuring sound continuity and also compensates for physical variations that may occur, such as relative movement, reverberations and frequency response variations.

The acoustic antiphase wave AAAS+ASYNC (86) generated by DSP2 (54) and broadcasted by the quieting loudspeaker (82) precisely matches in time and momentary antiphase amplitude with the AAAS+ASYNC (84) as heard at the quiet zone's edge (63). The two acoustic waves interfere each other, thus, significantly reduce the AAAS signal(s) (91) in the quiet zone.

Optionally, in order to further reduce the residual AAAS inside the quiet zone (63) an additional microphone, marked (70) in FIG. 6, may be used. This microphone is located in the quiet zone, preferably at its approximate center, and receives "residue" predefined AAAS originating from incomplete coherency between the incoming predefined AAAS and the generated antiphase AAAS.

Since the broadcasting of the matched antiphase AAAS in the Quiet Zone is dependent on the predefined AAAS as received by microphone Emic (62) in the quiet zone's edge, it is possible to vary the quiet zone's location according the user's desire or constrains (i.e. dynamic changing of the quiet zone's location within the area). The location change is done by moving the microphone Emic (62) and the antiphase quieting loudspeaker (82), and the optional microphone Imic (70), if in use, to a (new) desired quiet zone location.

The precise timing and momentary amplitude of the broadcasted antiphase AAAS+ASYNC (86) by the quieting loudspeaker (82) against predefined AAAS+ASYNC (84) broadcasted by loudspeaker (80, 81) as shown in FIG. 6, provides a quiet zone (63) where QAAS (94) can still be heard (QAAS are sounds such as, but not limited to, speaking and/or conversing near or at the quiet zone) while the predefined AAAS is not heard inside).

The present invention ensures that the listeners will not be interfered due the presence of the SYNC signals in the air: according FIG. 9, the amplitude of the broadcasted synchronization signal (551) is substantially small related to the audio amplitude of the predefined AAAS (553), thus, the SYNC signals are not heard by the listeners. Additionally, the SYNC signal amplitude is controlled by DSP2, as described earlier, by moving among system states Idle and Busy. This SYNC structure does not disturb human hearing while not distorting the predefined AAAS outside of the quiet zone or the QAAS within the quiet zone.

As presented in FIG. 8, each SYNC package (450) includes a well-defined GSM (452) which is associated to the time that the SYNC was generated at. As illustrated in FIG. 10, the GSM Time Tag enables DSP2 (54) to uniquely identify the specific package that earlier has been extracted from QEAAS+QESYNC (78), according the GSM time tag that recently extracted from QAAS+ASYNC (72). The identification ensures reliable and complete correlation of the audio signal between the electrically-stored signal which is used to build the antiphase signal, and the incoming acoustic signal at the quite zone Furthermore, optionally, as illustrated in FIG. 8, the SYNC signal may include additional data (453) to be used, not limited to, such as instruction-codes to activate parts of the "quieting system", upon request/need/demand/future plans, and/or other data.

The generation of the antiphase acoustic signal which is based on the electrical acoustic signal prior acquired, enables cancellation of predefined audio noise signals only, in the quiet zone, without interfering with other surrounding and in-zone audio signals.

Utilizing antiphase acoustic signal by using the pre-acquired electrical acoustic signal—significantly improves the predefined AAAS attenuation in the high-end of the audio frequency spectrum, where prior arts are limited.

The repetitive updating of the antiphase acoustic signal in the quiet zone in time and momentary amplitude ensures updating of the antiphase signal according to changes in the environment such as relative location of the components or listeners in the quiet zone.

It should be clear that the description of the embodiments and attached Figures set forth in this specification serves only for a better understanding of the invention, without limiting its scope.

It should also be clear that a person skilled in the art, after reading the present specification could make adjustments or amendments to the attached Figures and above described embodiments that would still be covered by the present invention.

We claim:

1. A method comprising:

acquiring noise from a noise source;

receiving a digitized version of the acquired noise;

generating a synchronization signal;

digitally combining the synchronization signal with the digitized version of the acquired noise;

acoustically broadcasting the synchronization signal by a loudspeaker positioned in close proximity to the noise source and being directed towards the predefined zone, such that the broadcasted synchronization signal and the noise are acoustically combined;

acquiring, using a microphone positioned at the predefined zone:

a) the acoustically-combined noise and broadcasted synchronization signal, and b) ambient noise at the predefined zone;

separating the broadcasted synchronization signal from the acquired (a) and (b);

calculating an antiphase signal based on:

c) the digitally-combined synchronization signal and digitized version of the noise, d) the acquired acoustically-combined noise and broadcasted synchronization signal, and e) the separated broadcasted synchronization signal; and acoustically broadcasting the antiphase signal using a loudspeaker, so as to substantially attenuate the noise as heard at the predefined zone.

2. The method according to claim 1, wherein said acquisition of the noise from the noise source is performed using a microphone positioned close to the noise source.

3. The method according to claim 1, wherein the calculation of the antiphase signal comprises calculating a distortion of an acoustical path between the noise source and the predefined zone, based on differences between the acquired synchronization signal and the generated synchronization signal.

4. The method according to claim 1, wherein:

the synchronization signal comprises consecutive packages separated by predefined time intervals;

each of the packages comprises a series of wave cycles that have a same amplitude; and each of the packages has a constant audio frequency.

5. The method according to claim 1, wherein the synchronization signal comprises consecutive packages, and wherein each of the packages contains at least one of:

a digitally-coded definition of a beginning of the respective package;

a digitally-coded counter that is indicative of the position of the respective package among the consecutive packages; and digitally-coded information on an audio frequency of the respective package.

6. The method according to claim 5, further comprising:

calculating an exact moment to acoustically broadcast the antiphase signal, based on a delay between the acoustic broadcast of the synchronization signal, and the acquisition of (a).

7. The method according to claim 6, wherein the delay is determined according to the digitally-coded definition of the beginning of the respective package.

8. The method according to claim 1, wherein the broadcasted synchronization signal has a lower amplitude than the noise.

9. The method according to claim 1, wherein said separation of the broadcasted synchronization signal from the acquired (a) and (b) is performed using a narrow band pass filter centered at an audio frequency of the synchronization signal.

10. The method according to claim 1, further comprising a step of calibration, before the noise is present, by generating white noise and performing the steps of claim 1 based on the white noise in lieu of the noise.

11. A system comprising a processor that is configured to cause execution of the following steps:

acquire noise from a noise source;

receive a digitized version of the acquired noise;

generate a synchronization signal;

digitally combine the synchronization signal with the digitized version of the acquired noise;

acoustically broadcast the synchronization signal by a loudspeaker positioned in close proximity to the noise source and being directed towards the predefined zone, such that the broadcasted synchronization signal and the noise are acoustically combined;

acquire, using a microphone positioned at the predefined zone:

a) the acoustically-combined noise and broadcasted synchronization signal, and b) ambient noise at the predefined zone;

separate the broadcasted synchronization signal from the acquired (a) and (b);

calculate an antiphase signal based on:

c) the digitally-combined synchronization signal and digitized version of the noise, d) the acquired acoustically-combined noise and broadcasted synchronization signal, and e) the separated broadcasted synchronization signal; and acoustically broadcast the antiphase signal using a loudspeaker, so as to substantially attenuate the noise as heard at the predefined zone.

12. The system according to claim 11, wherein said acquisition of the noise from the noise source is performed using a microphone positioned close to the noise source.

13. The system according to claim 11, wherein the calculation of the antiphase signal comprises calculating a distortion of an acoustical path between the noise source and the predefined zone, based on differences between the acquired synchronization signal and the generated synchronization signal.

14. The system according to claim 11, wherein:

the synchronization signal comprises consecutive packages separated by predefined time intervals;

each of the packages comprises a series of wave cycles that have a same amplitude; and each of the packages has a constant audio frequency.

15. The system according to claim 11, wherein the synchronization signal comprises consecutive packages, and wherein each of the packages contains at least one of:

a digitally-coded definition of a beginning of the respective package;

a digitally-coded counter that is indicative of the position of the respective package among the consecutive packages; and digitally-coded information on an audio frequency of the respective package.

16. The system according to claim 15, wherein said processor is further configured to cause execution of the following step:

calculate an exact moment to acoustically broadcast the antiphase signal, based on a delay between the acoustic broadcast of the synchronization signal, and the acquisition of (a).

17. The system according to claim 16, wherein the delay is determined according to the digitally-coded definition of the beginning of the respective package.

18. The system according to claim 11, wherein the broadcasted synchronization signal has a lower amplitude than the noise.

19. The system according to claim 11, wherein said separation of the broadcasted synchronization signal from the acquired (a) and (b) is performed using a narrow band pass filter centered at an audio frequency of the synchronization signal.

20. The system according to claim 11, wherein said processor is further configured to cause calibration, before the noise is present, by generating white noise and performing the steps of claim 1 based on the white noise in lieu of the noise.

* * * * *